US008921299B2

(12) United States Patent
Miracle et al.

(10) Patent No.: US 8,921,299 B2
(45) Date of Patent: Dec. 30, 2014

(54) DETERGENTS HAVING ACCEPTABLE COLOR

(75) Inventors: Gregory Scot Miracle, Hamilton, OH (US); Patrick Christopher Stenger, Fairfield, OH (US); Jean-Pol Boutique, Gembloux (BE)

(73) Assignee: The Procter & Gamble Company, Cincinnati, OH (US)

( * ) Notice: Subject to any disclaimer, the term of this patent is extended or adjusted under 35 U.S.C. 154(b) by 7 days.

(21) Appl. No.: 13/557,454

(22) Filed: Jul. 25, 2012

(65) Prior Publication Data

US 2013/0029896 A1 Jan. 31, 2013

Related U.S. Application Data

(60) Provisional application No. 61/511,250, filed on Jul. 25, 2011.

(51) Int. Cl.

| | |
|---|---|
| ***C11D 3/16*** | (2006.01) |
| ***C11D 3/33*** | (2006.01) |
| ***C11D 3/34*** | (2006.01) |
| ***C11D 3/36*** | (2006.01) |
| ***C11D 7/32*** | (2006.01) |
| ***C11D 7/34*** | (2006.01) |
| ***C11D 7/36*** | (2006.01) |

(52) U.S. Cl.

CPC .. *C11D 3/34* (2013.01); *C11D 3/33* (2013.01); *C11D 7/34* (2013.01); *C11D 7/36* (2013.01); *C11D 3/166* (2013.01); *C11D 7/3245* (2013.01); *C11D 3/364* (2013.01)

USPC ..... 510/276; 510/320; 510/321; 510/337; 510/346; 510/465; 510/469; 510/480; 510/495; 510/508

(58) Field of Classification Search

USPC ..... 510/276, 320, 321, 337, 346, 465, 480, 510/495, 508, 469

See application file for complete search history.

(56) References Cited

U.S. PATENT DOCUMENTS

| | | | | |
|---|---|---|---|---|
| 6,454,820 | B2 * | 9/2002 | Hagihara et al. | 51/308 |
| 2011/0220537 | A1 * | 9/2011 | Fernandez-Prieto et al. | 206/524.7 |
| 2012/0260433 | A1 * | 10/2012 | Tetard et al. | 8/137 |

FOREIGN PATENT DOCUMENTS

JP 2011026661 A * 2/2011

OTHER PUBLICATIONS

U.S. Appl. No. 13/493,055, filed Jul. 25, 2012, Chawla, et al.

* cited by examiner

*Primary Examiner* — Lorna M Douyon

(74) *Attorney, Agent, or Firm* — Gregory S. Darley-Emerson; Steven W. Miller

(57) ABSTRACT

This disclosure relates to detergent compositions containing tiron, a ligand capable of binding iron, an iron-displacing species, and iron. Methods for altering the color in a tiron-containing detergent composition are also disclosed.

11 Claims, No Drawings

DETERGENTS HAVING ACCEPTABLE COLOR

CROSS REFERENCE TO RELATED APPLICATION

This application claims priority to U.S. Provisional Application Ser. No. 61/511,250, filed Jul. 25, 2011.

FIELD OF THE INVENTION

This disclosure relates to detergent compositions containing tiron, a ligand capable of binding iron, an iron-displacing species, and iron.

BACKGROUND OF THE INVENTION

Catechols are defined as members of a family of aromatic diols having a substituted 1,2-benzenediol skeleton. Tiron, also known as 1,2-dihydroxybenzene-3,5-disulfonic acid, is one member of the catechol family and has the molecular structure shown in Scheme 1. Other sulphonated catechols also exist. In addition to the disulfonic acid, the term "tiron" may also include mono- or di-sulfonate salts of the acid, such as, for example, the disodium sulfonate salt.

Scheme 1

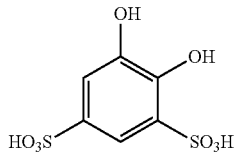

Tiron

Tiron and other catechols bind to ions of certain transition metals, such as ions of iron and titanium, and form colored metal/chelant complex. For example, in solutions tiron binds to ferric iron ($Fe^{3+}$) to form a burgundy red metal/tiron complex. The presence of this colored $Fe^{3+}$/tiron species may be detected at metal ion concentrations of 0.1 parts per million (ppm) or even lower. Thus, tiron has traditionally been used as a colorimetric indicator/chelant for the presence of titanium or iron.

Catechols, such as tiron, are also small molecule chelants that may be used as cleaning agents. For example, tiron delivers robust hydrophilic cleaning benefits and may also drive particulate cleaning via clay peptization, suspension, and/or synergy with polymeric dispersing systems. In addition, tiron may be compatible with certain enzymatic cleaning agents used in certain detergent compositions.

However, many detergent compositions contain low concentrations of soluble iron, such as ferric iron. The concentration of ferric iron in these detergents is enough to form sufficient metal/chelant complexes with certain catechols, such as tiron, to give the detergent an undesirable reddish color. This is particularly true for liquid detergent compositions in which the soluble ferric iron may freely complex with the tiron in the liquid detergent. For example, addition of low levels of tiron to commercially available detergents results in the detergent acquiring a reddish hue associated with the formation of the iron/tiron complex.

Many consumers may disfavor reddish colored detergents. For example, a reddish color in detergent may be associated with rust. Thus, in order to allow production of detergent compositions within the broadest possible color space, many detergent producers specifically avoid red chromophores.

The presence of red chromophores in a detergent formulation may result in additional cost required to remove the red color from the detergent. Since detergents comprising certain catechols, such as tiron, would result in a reddish hue to the detergent composition due to the presence of ferric iron, many catechols, including tiron, have not traditionally been used in detergent applications, particularly in liquid detergents.

It would be desirable to produce a detergent possessing the cleaning benefits associated with tiron without the concomitant formation of the reddish iron/chelate complex.

SUMMARY OF THE INVENTION

In one aspect, the present disclosure provides a detergent composition. The detergent composition comprises tiron, a ligand capable of chelating to $Fe^{3+}$, where the ligand has a binding constant for $Fe^{3+}$ that is greater than $10^{18}M^{-1}$, an iron-displacing species, and $Fe^{3+}$. The iron-displacing species is selected from the group consisting of i) a boron-containing compound of formula $RB(OH)_2$, where R is not OH, ii) $Al^{3+}$, and iii) mixtures thereof. The $Fe^{3+}$ and the ligand may form a complex having a color substantially less intense than the color of the iron/tiron chelate.

Other aspects of the invention include methods of reducing the intensity of a red color in a tiron-containing detergent composition.

DETAILED DESCRIPTION OF THE INVENTION

A. Definitions

As used herein, the term "catechol" includes substituted and unsubstituted 1,2-dihydroxybenzenes.

As used herein, the term "tiron" includes 1,2-diydroxybenzene-3,5-disulfonic acid and mono- and di-sulfonate salts thereof.

As used herein, the term "$Fe^{3+}$/ligand complex" or "metal/ligand complex" means the complex formed when a metal ion (such as $Fe^{3+}$) binds to a ligand via an ionic, covalent, or coordinate covalent bond.

As used herein, the term "binding constant" is a measurement of the equilibrium state of binding, such as binding between a metal ion and a ligand to form a complex. In certain cases, the binding constant $K_{bc}$ may be calculated using the following equation:

$$K_{bc}=[ML_x]/([M][L]^x)$$

where [L] is the concentration of ligand (in mol/L), x is the number of ligands that bond to the metal, [M] is the concentration of metal ion, and $[ML_x]$ is the concentration of the metal/ligand complex. Unless otherwise specified, all binding constants disclosed herein are measured at 25° C. and an ionic strength (I) of 0.1 mol/L. Specific values of binding constants cited herein are taken from the National Institute of Standards and Technology ("NIST"), R. M. Smith, and A. E. Martell, NIST Standard Reference Database 46, NIST Critically Selected Stability Constants of Metal Complexes: Version 8.0, May 2004, U.S. Department of Commerce, Technology Administration, NIST, Standard Reference Data Program, Gaithersburg, Md.

B. Detergent Composition

The present disclosure is directed to the development of detergent compositions comprising catechols, such as tiron, that do not develop a visible or significant red or reddish color due to metal/ligand complex formation between the catechol ligand and residual soluble iron, such as ferric iron, in the detergent. In some aspects, the detergent compositions of the invention comprise at least about 0.2 ppm $Fe^{3+}$. Inhibiting the formation of iron/tiron complexes, and the concomitant red coloration, allows the incorporation of tiron into detergent compositions, such as heavy duty liquid (HDL) detergents. One approach according to certain aspects of the present disclosure includes adding a ligand capable of chelating to $Fe^{3+}$, where the ligand has a binding constant for $Fe^{3+}$ that is greater than $10^{18}M^{-1}$ (units assume a mono-complex of the ligand and ferric iron), and an iron-displacing species to the detergent composition. The ligand preferentially binds to or complexes with the ferric iron in the detergent to form a non-colored complex or a complex having a color that is compatible with the detergent system and/or consumer preferences. The iron-displacing species, on the other hand, binds to or complexes with tiron to form a non-colored complex or a complex having a color that is compatible with the detergent system and/or consumer preferences. In this way, the formation of colored $Fe^{3+}$/tiron complexes is inhibited. Furthermore, the iron-displacing species/tiron complex dissociates upon dilution with water, e.g., in the wash, such that tiron may deliver its hydrophilic cleaning benefits and/or drive particulate cleaning via clay peptization, suspension, and/or synergy with polymeric dispersing systems.

Tiron

It should be noted that while certain aspects herein describe the use of the catechol tiron, other catechols, such as, but not limited to, other catechol disulfonic acids, catechol monosulfonic acids and their acid salts, may possibly be substituted for tiron.

In some aspects, the detergent compositions of the present invention comprise tiron. In certain aspects, the detergent compositions comprise from about 0.015% by weight to about 10% by weight of the composition of tiron, in some aspects, about 0.05% by weight to about 5% by weight, in further aspects, from about 0.1% by weight to about 2% by weight.

In certain aspects, the mole percentage of tiron that is bound to $Fe^{3+}$ is less than about 50%, in some aspects, less than about 25%, in further aspects, less than about 10%, in other aspects, less than about 5%, and in still further aspects, less than about 2%.

Ligand Capable of Chelating to Ferric Iron

Examples of compounds capable of bonding to or complexing with the ferric iron include chelating ligands which form chelates with the ferric iron and can out compete tiron for soluble iron, in the presence of a suitable iron-displacing species, in an HDL detergent. In some aspects, the present disclosure relates to a detergent composition comprising tiron and a ligand capable of chelating to ferric iron in the detergent, wherein a complex formed between the ligand and iron has less intense color or a color that is compatible with the detergent system and/or consumer preferences. The ligand capable of chelating to ferric iron in the detergent may preferentially bind with the soluble ferric iron in the detergent, thereby reducing the concentration of the soluble ferric iron free to bind to other species, such as tiron. As the soluble ferric iron binds to the ligand capable of chelating to ferric iron, the ferric iron is unavailable to bind with the tiron and thereby form the red colored iron/tiron complex.

In certain aspects, the ligand capable of chelating to ferric iron has a binding constant for ferric iron of at least $10^{18}$ $M^{-1}$. The ligand capable of chelating to ferric iron has a binding constant for ferric iron that is typically less than about $10^{50}$ $M^{-1}$. As defined herein, the binding constant is a measure of the equilibrium state of binding, such as binding between a ferric iron ion and a ligand to form a complex.

Tiron can bind iron with different stoichiometries, depending on the identity of the limiting reagent, tiron or iron. Mono-, bis-, and tris-complexes of tiron with iron are known (Sever, M., & Wilker, J. (2004). Visible absorption spectra of metal-catecholate and metal-tironate complexes. *Dalton Transactions*, (7), Table 1, 1070). At the levels typically used in HDL detergents, iron is the limiting reagent, which may lead to the formation of the tris-complex. For example, the binding constant of $Fe^{3+}$ to tiron, in a mono-complex, is reported to be about $10^{20.3}$ $M^{-1}$. The bis- and tris-complexes have binding constants of $10^{35.2}M^{-2}$ and $10^{46.0}$ $M^{-3}$, respectively. In cases where the tris-complex predominates, e.g., where iron is the limiting reagent, ligands having binding constants less than $10^{46.0}M^{-1}$ would not be expected to outcompete tiron for the available iron, without the presence of an iron-displacing species. Surprisingly, a ligand with a binding constant for ferric iron ranging from about $10^{18}M^{-1}$ to about $10^{46}M^{-1}$ will bind preferentially to the ferric iron over tiron, but only in the presence of an iron-displacing species. In certain aspects, the ligand may have a binding constant for ferric iron ranging from about $10^{18}M^{-1}$ to about $10^{46}M^{-1}$ (units assume a mono-complex of the ligand and ferric iron).

In some aspects, the ligand capable of chelating to ferric iron may be selected from the group consisting of aminocarboxylates containing at least two N atoms, aminophosphonates containing at least two N atoms, and geminal bisphosphonates. In certain aspects, the ligand capable of chelating to ferric iron may be selected from the group consisting of diethylenetriaminepentaacetic acid ("DTPA"), ethylenediaminetetraacetic acid ("EDTA"), propylene diamine tetracetic acid ("PDTA"), hydroxy-ethane diphosphonic acid ("HEDP"), N-(hydroxyethyl)-ethylenediaminetriacetic acid ("HEDTA"), ethylenediamine-N,N'-disuccinic acid ("EDDS"), diethylene triamine penta methylene phosphonic acid ("DTPMP"), sodium salt of carboxymethylated polyethyleneimine (Trilon® P, manufactured by BASF Corporation), and combinations thereof. Typically, the ligand capable of chelating to ferric iron has a molecular weight ranging from about 100 daltons to about 100,000 daltons. Other suitable ligands capable of chelating to ferric iron are disclosed in A. E. Martell, R. D. Hancock, "Metal Complexes in Aqueous Solutions" in Modern Inorganic Chemistry, Plenum Press, New York, N.Y., 1996, pp 58-197 and specifically at pp 151-158. The ligands recited herein include the free acid ligand and the various acid salts, such as the mono-, di-, tri-, tetra- and pentaacetate salts (including the alkali metal salts) and the mono-, di-, tri-, tetra- and pentaphosphonate salts.

In certain aspects, the ligand is DTPA, including the pentasodium acetate salt. In some aspects, the ligand is DTPMP. In some aspects, the ligand is HEDP. In other aspects, the ligand is sodium salt of carboxymethylated polyethyleneimine (Trilon® P, manufactured by BASF Corporation). For example, in certain countries, elemental phosphorus content in detergent compositions may be restricted. In such countries, such as the United States of America, phosphate free ligands, such as DTPA or Trilon® P, may serve as a ligand. In other countries, where elemental phosphorus content in detergent compositions is not strictly regulated, phosphorus containing ligands, such as DTPMP or HEDP, may be used as an alternative to DTPA or as a mixture with DTPA. The binding constant for DTPA with ferric iron is about $10^{27.7}M^{-1}$, whereas the binding constant for DTPMP with ferric iron is greater than $10^{28}M^{-1}$, whereas the binding constant for HEDP with ferric iron is $10^{19.1}M^{-1}$ at 25° C. at an ionic strength (I) of 0.015 mol/L. In the presence of a suitable iron-displacing species, ferric iron will bind preferentially to the ligand, for example, DTPA, HEDP or DTPMP, over tiron and therefore not form noticeable concentrations of the colored metal/tiron complex in the detergent composition.

DTPA, HEDP or DTPMP may also provide hydrophilic cleaning benefits when added to certain HDL detergent compositions.

In certain aspects, the concentration of ligand capable of chelating $Fe^{+3}$ in the detergent composition may range from about 0.015% by weight to about 10.0% by weight of the composition. In certain aspects, the ligand concentration in the detergent composition may range from about 0.015% by weight to about 0.35% by weight of the composition. In some aspects, the ligand concentration in the detergent composition may range from about 0.05% by weight to about 5.0% by weight of the composition, and, in still other aspects, the ligand concentration may range about 0.10% by weight to about 2.0% by weight.

In some aspects, the molar ratio of tiron to the ligand capable of chelating $Fe^{+3}$ to $Fe^{+3}$ (tiron:ligand:$Fe^{+3}$) in the composition is from about 1:0.1(b/x):0.008 to about 1:5(b/x):0.35, where x is the molecular weight of the acid form of the ligand and where b=278 for aminocarboxylates containing at least two nitrogen atoms, b=573 for aminophosphonates containing at least two nitrogen atoms, and b=206 for geminal bisphosphonates.

Iron-Displacing Species

In some aspects, the present disclosure relates to a detergent composition comprising tiron, a ligand capable of chelating to ferric iron in the detergent, and an iron-displacing species. The iron-displacing species binds to or complexes with tiron to form a non-colored complex or a complex having a color that is compatible with the detergent system and/or consumer preferences. In this way, the formation of colored $Fe^{3+}$/tiron complexes is inhibited.

In certain aspects, the iron-displacing species is selected from the group consisting of i) a boron-containing compound of formula $RB(OH)_2$, where R is not OH, ii) $Al^{3+}$, and iii) mixtures thereof. In some aspects, the iron-displacing species is a boron-containing compound of formula $RB(OH)_2$, where R is a substituted or unsubstituted aryl or heteroaryl group. In some aspects, the iron-displacing species is a boron-containing compound of formula $RB(OH)_2$, where R is selected from the group consisting of substituted or unsubstituted C6-C10 aryl groups and substituted or unsubstituted C1-C10 alkyl groups. In certain aspects, R is selected from the group consisting of substituted or unsubstituted C6 aryl groups and substituted or unsubstituted C1-C4 alkyl groups. In some aspects, the iron-displacing species is selected from the group consisting of phenylboronic acid, ethylboronic acid, 3-nitrobenzeneboronic acid, and mixtures thereof.

Additional suitable non-limiting examples of iron-displacing species are boron-containing compounds having formula I:

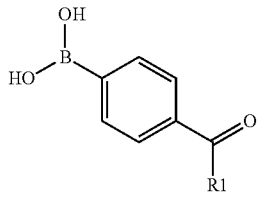

(I)

wherein $R^1$ is selected from the group consisting of hydrogen, hydroxy, C1-C6 alkyl, substituted C1-C6 alkyl, C2-C6 alkenyl and substituted C2-C6 alkenyl.

In one aspect of the present disclosure, a liquid composition includes a boron-containing compound of formula I, wherein $R^1$ is a C1-C6 alkyl, in particular wherein $R^1$ is $CH_3$, $CH_3CH_2$ or $CH_3CH_2CH_2$, or wherein $R^1$ is hydrogen. In one aspect of the present disclosure, the boron-containing compound is 4-formyl-phenyl-boronic acid (4-FPBA).

In some aspects, suitable non-limiting examples of boron-containing compounds include compounds selected from the group consisting of: thiophene-2 boronic acid, thiophene-3 boronic acid, acetamidophenyl boronic acid, benzofuran-2 boronic acid, naphtalene-1 boronic acid, naphtalene-2 boronic acid, 2-FPBA, 3-FBPA, 4-FPBA, 1-thianthrene boronic acid, 4-dibenzofuran boronic acid, 5-methylthiophene-2 boronic, acid, thionaphtrene boronic acid, furan-2 boronic acid, furan-3 boronic acid, 4,4 biphenyl-diborinic acid, 6-hydroxy-2-naphtalene, 4-(methylthio)phenyl boronic acid, 4 (trimethyl-silyl)phenyl boronic acid, 3-bromothiophene boronic acid, 4-methylthiophene boronic acid, 2-naphtyl boronic acid, 5-bromothiphene boronic acid, 5-chlorothiophene boronic acid, dimethylthiophene boronic acid, 2-bromophenyl boronic acid, 3-chlorophenyl boronic acid, 3-methoxy-2-thiophene, p-methyl-phenylethyl boronic acid, 2-thianthrene boronic acid, di-benzothiophene boronic acid, 4-carboxyphenyl boronic acid, 9-anthryl boronic acid, 3,5 dichlorophenyl boronic, acid, diphenyl boronic acidanhydride, o-chlorophenyl boronic acid, p-chlorophenyl boronic acid, m-bromophenyl boronic acid, p-bromophenyl boronic acid, p-flourophenyl boronic acid, p-tolyl boronic acid, o-tolyl boronic acid, octyl boronic acid, 1,3,5 trimethylphenyl boronic acid, 3-chloro-4-flourophenyl boronic acid, 3-aminophenyl boronic acid, 3,5-bis-(triflouromethyl)phenyl boronic acid, 2,4 dichlorophenyl boronic acid, 4-methoxyphenyl boronic acid, and combinations thereof.

Further non-limiting examples of suitable boron-containing compounds are described in U.S. Patent Appl. No. 2010/0120649, U.S. Pat. No. 4,963,655, U.S. Pat. No. 5,159,060, WO 95/12655, WO 95/29223, WO 92/19707, WO 94/04653, WO 94/04654, U.S. Pat. No. 5,442,100, U.S. Pat. No. 5,488,157 and U.S. Pat. No. 5,472,628 (herein incorporated by reference in their entirety).

In certain aspects, the detergent compositions of the invention comprise from about 0.05% to about 2% by weight of the composition of a boron-containing compound of formula $RB(OH)_2$, where R is not OH, such as the boron-containing compound of formula I. In further aspects, the detergent compositions of the invention comprise from about 0.1% to about 2% or from about 0.2% to about 2% by weight of the composition of a boron-containing compound of formula $RB(OH)_2$, where R is not OH, such as the boron-containing compound of formula I. In still further aspects, the detergent compositions of the invention comprise from about 0.3% to about 1.0% by weight of the composition of a boron-containing compound of formula $RB(OH)_2$, where R is not OH, such as the boron-containing compound of formula I.

In some aspects, the iron-displacing species is $Al^{3+}$, where the molar ratio of tiron to $Al^{3+}$ in the composition is from about 3:1 to about 1:20. In further aspects, the molar ratio of tiron to $Al^{3+}$ is from about 2:1 to about 1:10. In still further aspects, the molar ratio of tiron to $Al^{3+}$ is from about 2:1 to about 1:5. In some aspects, the detergent compositions of the invention comprise from about 0.015% to about 0.15% $Al^{3+}$.

In certain aspects, the iron-displacing species is a boric acid derivative and the detergent composition comprises from about 0.05% by weight to about 20% boric acid derivative. In certain aspects, the detergent compositions of the invention comprise from about 0.05% to about 2% by weight of the composition of a boric acid derivative. In further aspects, the detergent compositions of the invention comprise from about 0.1% to about 2% or from about 0.2% to about 2% by weight of the composition of a boric acid derivative. In still further aspects, the detergent compositions of the invention comprise from about 0.3% to about 1.0% by weight of the composition of a boric acid derivative. By "boric acid derivatives" it is meant boron containing compounds, such as boric acid per se, and other boric acid derivatives, at least a part of which are present in solution as boric acid or a chemical equivalent thereof. Illustrative examples of boric acid derivatives includes boric acid, MEA-borate, borax, boric oxide, tetraborate decahydrate, tetraborate pentahydrate, alkali metal borates (such as sodium ortho-, meta- and pyroborate and sodium pentaborate) and mixtures thereof.

$Ca^{2+}$

In some aspects, the detergent composition may further comprise at least one calcium salt. Examples of calcium salts suitable for use in the present detergent compositions include water soluble salts of $Ca^{2+}$ ions, such as, for example, calcium formate, calcium chloride, calcium bromide, calcium iodide, calcium sulfide, calcium nitrate, calcium acetate, and combinations of any thereof. In certain aspects, the calcium salt may be calcium formate. In some aspects, the detergent composition may comprise a calcium salt selected from the group consisting of calcium formate and calcium chloride.

In certain formulations, calcium ions ($Ca^{2+}$) may act to stabilize certain enzymatic components in a detergent composition. For example, NATALASE® (commercially available from Novozymes A/S Corp., Denmark), is an alpha amylase enzyme that may be used in certain HDL detergent compositions, for example for the removal of certain starch-based stains.

Other enzymes commonly added to HDL detergent compositions include, for example, proteases (such as Alcalase, Esperase, Savinase and Maxatase), amylases (such as Termamyl), lipases, oxidases, oxygenases, peroxidases, cellulases, hemicellulases, xylanases, phospholipases, esterases, cutinases, pectinases, keratanases, reductases, oxidases, phenoloxidases, lipoxygenases, ligninases, pullulanases, tannases, pentosanases, malanases, b-glucanases, arabinosidases, hyaluronidases, chondroitinases, laccases, and mixtures of any thereof. Calcium ions ($Ca^{2+}$) may act to stabilize certain amylases (such as, but not limited to, NATALASE®) or certain other enzymes in detergent compositions. Therefore, certain concentrations of calcium ions may enhance enzymatic cleaning activity in detergent compositions.

In enzyme-containing detergents, the binding of the ligand capable of chelating to ferric iron to other metal ions in the detergent, such as $Ca^{2+}$, may be important. Therefore, according to certain aspects of the invention, the binding of the ligand to other ions, such as $Ca^{2+}$, is sufficiently low, so as not to reduce the stabilizing effect of the other ion on detergent enzymes.

In certain aspects, the calcium salt is present in an amount sufficient to provide from about 0.1 ppm to about 500 ppm of free $Ca^{2+}$ ion. In some aspects, the detergent composition may comprise sufficient calcium salts to have a free calcium ion concentration ranging between about 100 ppm and about 400 ppm. For example, in one aspect where the calcium salt is calcium formate, the concentration of calcium formate in the detergent composition may range from about 0.04% to about 1.60% (w/w) of calcium formate. This value of calcium formate equals from about 0.01 to about 0.4% (w/w) of calcium ion, which corresponds to about 100 ppm to about 400 ppm.

The molar ratio of the ligand capable of chelating ferric iron to the calcium ion may be important for maintaining acceptable color control while maintaining enzymatic stability and activity. For example, in those aspects where the ligand is DTPA, calcium ion may reduce the effectiveness of the DTPA for color control, but high levels of DTPA (relative to calcium ion) may destabilize certain enzymes, e.g., NATALASE®. Therefore, a specific range of molar ratios of ligand to calcium ion exists for optimum color control and enzyme activity/stability. In certain aspects, the molar ratio of ligand to $Ca^{2+}$ ranges from about 1(b/x):0.4 to about 1(b/x):10, where b and x are as defined above.

The binding constant of tiron for $Ca^{2+}$ is about $10^{5.6}M^{-1}$, whereas the binding constant of DTPA for $Ca^{2+}$ is about $10^{10.8}M^{-1}$. Thus, DTPA may be a suitable ligand that binds strongly to $Fe^{3+}$ ion and binds less strongly to $Ca^{2+}$ ions.

pH

According to certain aspects of the detergent compositions disclosed herein, the pH of the detergent composition may have an effect on color formation and/or enzyme stability. According to one aspect, the detergent compositions may have a pH ranging from about 6 to about 10. In another aspect, the detergent composition may have a pH ranging from about 7 to about 9. In another aspect, the detergent composition may have a pH ranging from about 7.5 to about 8.5. In another aspect, the detergent composition may have a pH of about 8.

Surfactant

According to certain aspects disclosed herein, the detergent compositions of the present disclosure may further comprise a surfactant. Such compositions may comprise a sufficient amount of a surfactant to provide the desired level of one or more cleaning properties, typically from about 5% to about 90% by weight of the total composition, from about 5% to about 70% by weight of the total composition, or from about 5% to about 40% by weight of the total composition. Typically, the detergent is used in the wash solution at a level of from about 0.0001% to about 0.05%, or even from about 0.001% to about 0.01% by weight of the wash solution.

The liquid detergent compositions may comprise an aqueous, non-surface active liquid carrier. Generally, the amount of the aqueous, non-surface active liquid carrier employed in the compositions herein will be effective to solubilize, suspend, or disperse the composition components. For example, the compositions may comprise, by weight, from about 5% to about 90%, from about 10% to about 70%, or from about 20% to about 70% of an aqueous, non-surface active liquid carrier.

The most cost effective type of aqueous, non-surface active liquid carrier may be water. Accordingly, the aqueous, non-surface active liquid carrier component may be mostly, if not completely, water. While other types of water-miscible liquids, such alkanols, diols, other polyols, ethers, amines, and the like, have been conventionally added to liquid detergent compositions as co-solvents or stabilizers, the utilization of such water-miscible liquids may be minimized to hold down composition cost. Accordingly, the aqueous liquid carrier component of the liquid detergent products herein will generally comprise water present in concentrations ranging from about 5% to about 90%, or from about 20% to about 70%, by weight of the composition.

The liquid detergent compositions herein may take the form of an aqueous solution or uniform dispersion or suspension of surfactant, dual character polymer, and certain optional adjunct ingredients, some of which may normally be in solid form, that have been combined with the normally liquid components of the composition, such as the liquid alcohol ethoxylate nonionic, the aqueous liquid carrier, and any other normally liquid optional ingredients. Such a solution, dispersion or suspension will be acceptably phase stable and will typically have a viscosity which ranges from about 100 to 600 cps, or from about 150 to 400 cps. For purposes of this disclosure, viscosity is measured with a Brookfield LVDV-II+viscometer apparatus using a #21 spindle.

Suitable surfactants may be anionic, nonionic, cationic, zwitterionic and/or amphoteric surfactants. In one aspect, the detergent composition comprises anionic surfactant, nonionic surfactant, or mixtures thereof.

Suitable anionic surfactants may be any of the conventional anionic surfactant types typically used in liquid detergent products. Such surfactants include the alkyl benzene sulfonic acids and their salts as well as alkoxylated or non-alkoxylated alkyl sulfate materials. Exemplary anionic surfactants are the alkali metal salts of $C_{10}$-$C_{16}$ alkyl benzene sulfonic acids, preferably $C_{11}$-$C_{14}$ alkyl benzene sulfonic acids. In one aspect, the alkyl group is linear. Such linear alkyl benzene sulfonates are known as "LAS". Such surfactants and their preparation are described for example in U.S. Pat. Nos. 2,220,099 and 2,477,383. Especially preferred are the sodium and potassium linear straight chain alkylbenzene sulfonates in which the average number of carbon atoms in the alkyl group is from about 11 to 14. Sodium $C_{11}$-$C_{14}$ LAS, e.g., $C_{12}$ LAS, are a specific example of such surfactants.

Another exemplary type of anionic surfactant comprises ethoxylated alkyl sulfate surfactants. Such materials, also known as alkyl ether sulfates or alkyl polyethoxylate sulfates, are those which correspond to the formula: $R'—O—(C_2H_4O)_n—SO_3M$ wherein R' is a $C_8$-$C_{20}$ alkyl group, n is from about 1 to 20, and M is a salt-forming cation. In a specific aspect, R' is $C_{10}$-$C_{18}$ alkyl, n is from about 1 to 15, and M is sodium, potassium, ammonium, alkylammonium, or alkanolammonium. In more specific aspects, R' is a $C_{12}$-$C_{16}$, n is from about 1 to 6 and M is sodium.

The alkyl ether sulfates will generally be used in the form of mixtures comprising varying R' chain lengths and varying degrees of ethoxylation. Frequently such mixtures will inevitably also contain some non-ethoxylated alkyl sulfate materials, i.e., surfactants of the above ethoxylated alkyl sulfate formula wherein n=0. Non-ethoxylated alkyl sulfates may also be added separately to the compositions of this invention and used as or in any anionic surfactant component which may be present. Specific examples of non-alkoyxylated, e.g., non-ethoxylated, alkyl ether sulfate surfactants are those produced by the sulfation of higher $C_8$-$C_{20}$ fatty alcohols. Conventional primary alkyl sulfate surfactants have the general formula: $ROSO_3^-M^+$ wherein R is typically a $C_8$-$C_{20}$ alkyl group, which may be straight chain or branched chain, and M is a water-solubilizing cation. In specific aspects, R is a $C_{10}$-$C_{15}$ alkyl group, and M is alkali metal, more specifically R is $C_{12}$-$C_{14}$ alkyl and M is sodium.

Specific, non-limiting examples of anionic surfactants useful herein include: a) $C_{11}$-$C_{18}$ alkyl benzene sulfonates (LAS); b) $C_{10}$-$C_{20}$ primary, branched-chain and random alkyl sulfates (AS); c) $C_{10}$-$C_{18}$ secondary (2,3)-alkyl sulfates having formulae (I) and (II):

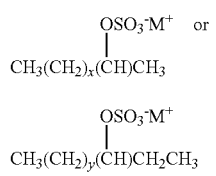

(I)

(II)

wherein M in formulae (I) and (II) is hydrogen or a cation which provides charge neutrality, and all M units, whether associated with a surfactant or adjunct ingredient, can either be a hydrogen atom or a cation depending upon the form isolated by the artisan or the relative pH of the system wherein the compound is used, with non-limiting examples of preferred cations including sodium, potassium, ammonium, and mixtures thereof, and x is an integer of at least about 7, preferably at least about 9, and y is an integer of at least 8, preferably at least about 9; d) $C_{10}$-$C_{18}$ alkyl alkoxy sulfates ($AE_zS$) wherein preferably z is from 1-30; e) $C_{10}$-$C_{18}$ alkyl alkoxy carboxylates preferably comprising 1-5 ethoxy units; f) mid-chain branched alkyl sulfates as discussed in U.S. Pat. Nos. 6,020,303 and 6,060,443; g) mid-chain branched alkyl alkoxy sulfates as discussed in U.S. Pat. Nos. 6,008,181 and 6,020,303; h) modified alkylbenzene sulfonate (MLAS) as discussed in WO 99/05243, WO 99/05242, WO 99/05244, WO 99/05082, WO 99/05084, WO 99/05241, WO 99/07656, WO 00/23549, and WO 00/23548; i) methyl ester sulfonate (MES); and j) alpha-olefin sulfonate (AOS).

Suitable nonionic surfactants useful herein may comprise any of the conventional nonionic surfactant types typically used in liquid detergent products. These include, for example, alkoxylated fatty alcohols and amine oxide surfactants. Preferred for use in the liquid detergent products herein are those nonionic surfactants which are normally liquid. Suitable nonionic surfactants for use herein include the alcohol alkoxylate nonionic surfactants. Alcohol alkoxylates are materials which correspond to the general formula: $R^1(C_mH_{2m}O)_pOH$ wherein $R^1$ is a $C_8$-$C_{16}$ alkyl group, m is from 2 to 4, and p ranges from about 2 to 12. Preferably $R^1$ is an alkyl group which may be primary or secondary and that contains from about 9 to about 15 carbon atoms, more preferably from about 10 to about 14 carbon atoms. In one aspect, the alkoxylated fatty alcohols may also be ethoxylated materials that contain from about 2 to about 12 ethylene oxide moieties per molecule, more preferably from about 3 to about 10 ethylene oxide moieties per molecule.

The alkoxylated fatty alcohol materials useful in the liquid detergent compositions herein will frequently have a hydrophilic-lipophilic balance (HLB) which ranges from about 3 to 17. More preferably, the HLB of this material will range from about 6 to 15, most preferably from about 8 to 15. Suitable alkoxylated fatty alcohol nonionic surfactants have been marketed under the tradename NEODOL® by the Shell Chemical Company.

Another suitable type of nonionic surfactant useful herein comprises the amine oxide surfactants. Amine oxides are materials which are often referred to in the art as "semi-polar" nonionics. Amine oxides have the formula: $R^2(EO)_f(PO)_g(BO)_hN(O)(CH_2R^3)_2.qH_2O$. In this formula, $R^2$ is a relatively long-chain alkyl moiety which can be saturated or unsaturated, linear or branched, and can contain from 8 to 20, preferably from 10 to 16 carbon atoms, and is more preferably a $C_{12}$-$C_{16}$ primary alkyl. $R^3$ is a short-chain moiety, preferably selected from hydrogen, methyl and $—CH_2OH$. When f+g+h is different from 0, EO is ethyleneoxy, PO is propyleneneoxy and BO is butyleneoxy. Exemplary amine oxide surfactants may be illustrated by $C_{12}$-$C_{14}$ alkyldimethyl amine oxide.

Non-limiting examples of nonionic surfactants include: a) $C_{12}$-$C_{18}$ alkyl ethoxylates, such as, NEODOL® nonionic surfactants from Shell; b) $C_6$-$C_{12}$ alkyl phenol alkoxylates wherein the alkoxylate units are a mixture of ethyleneoxy and propyleneoxy units; c) $C_{12}$-$C_{18}$ alcohol and $C_6$-$C_{12}$ alkyl phenol condensates with ethylene oxide/propylene oxide block polymers such as PLURONIC® from BASF; d) $C_{14}$-$C_{22}$ mid-chain branched alcohols ("BA") as discussed in U.S. Pat. No. 6,150,322; e) $C_{14}$-$C_{22}$ mid-chain branched alkyl alkoxylates ("$BAE_z$"), wherein z is 1-30, as discussed in U.S. Pat. Nos. 6,153,577; 6,020,303; and 6,093,856; f) alkyl-polysaccharides as discussed in U.S. Pat. No. 4,565,647; specifically alkylpolyglycosides as discussed in U.S. Pat. Nos. 4,483,780 and 4,483,779; g) Polyhydroxy fatty acid amides as discussed in U.S. Pat. No. 5,332,528, WO 92/06162, WO 93/19146, WO 93/19038, and WO 94/09099; and h) ether capped poly (oxyalkylated) alcohol surfactants as discussed in U.S. Pat. No. 6,482,994 and WO 01/42408.

In certain aspects of the laundry detergent compositions herein, the detersive surfactant component may comprise combinations of anionic and nonionic surfactant materials. When this is the case, the weight ratio of anionic to nonionic will typically range from 10:90 to 90:10, more typically from 30:70 to 70:30.

Cationic surfactants are known in the art and non-limiting examples of these include quaternary ammonium surfactants, which can have up to 26 carbon atoms. Additional examples include a) alkoxylate quaternary ammonium ("AQA") surfactants as discussed in U.S. Pat. No. 6,136,769; b) dimethyl hydroxyethyl quaternary ammonium as discussed in U.S. Pat. No. 6,004,922; c) polyamine cationic surfactants as discussed in WO 98/35002, WO 98/35003, WO 98/35004, WO 98/35005, and WO 98/35006; d) cationic ester surfactants as discussed in U.S. Pat. Nos. 4,228,042; 4,239,660; 4,260,529; and 6,022,844; and e) amino surfactants as discussed in U.S. Pat. No. 6,221,825 and WO 00/47708, such as amido propyldimethyl amine ("APA").

Non-limiting examples of zwitterionic surfactants include: derivatives of secondary and tertiary amines, derivatives of heterocyclic secondary and tertiary amines, or derivatives of quaternary ammonium, quaternary phosphonium or tertiary sulfonium compounds. See U.S. Pat. No. 3,929,678 at column 19, line 38 through column 22, line 48, for examples of zwitterionic surfactants; betaines, including alkyl dimethyl betaine and cocodimethyl amidopropyl betaine, $C_8$ to $C_{18}$ (for example from $C_{12}$ to $C_{18}$) amine oxides and sulfo and hydroxy betaines, such as N-alkyl-N,N-dimethylammino-1-propane sulfonate where the alkyl group can be $C_8$ to $C_{18}$ and in certain s from $C_{10}$ to $C_{14}$.

Non-limiting examples of ampholytic surfactants include: aliphatic derivatives of secondary or tertiary amines, or aliphatic derivatives of heterocyclic secondary and tertiary amines in which the aliphatic radical can be straight- or branched-chain. One of the aliphatic substituents may contain at least about 8 carbon atoms, for example from about 8 to about 18 carbon atoms, and at least one contains an anionic water-solubilizing group, e.g. carboxy, sulfonate, sulfate. See U.S. Pat. No. 3,929,678 at column 19, lines 18-35, for suitable examples of ampholytic surfactants.

Nonlimiting examples of surfactant systems include the conventional $C_{11}$-$C_{18}$ alkyl benzene sulfonates ("LAS") and primary, branched-chain and random $C_{10}$-$C_{20}$ alkyl sulfates ("AS"), the $C_{10}$-$C_{18}$ secondary (2,3)-alkyl sulfates of the formula $CH_3(CH_2)_x(CHOSO_3^-M^+)CH_3$ and $CH_3(CH_2)_y(CHOSO_3^-M^+)CH_2CH_3$ where x and (y+1) are integers of at least about 7, in other s at least about 9, and M is a water-solubilizing cation, especially sodium, unsaturated sulfates such as oleyl sulfate, the $C_{10}$-$C_{18}$ alkyl alkoxy sulfates ("$AE_zS$"; especially EO 1-7 ethoxy sulfates), $C_{10}$-$C_{18}$ alkyl alkoxy carboxylates (especially the EO 1-5 ethoxycarboxylates), the $C_{10}$-$C_{18}$ glycerol ethers, the $C_{10}$-$C_{18}$ alkyl polyglycosides and their corresponding sulfated polyglycosides, and $C_{12}$-$C_{18}$ alpha-sulfonated fatty acid esters. If desired, the conventional nonionic and amphoteric surfactants such as the $C_{12}$-$C_{18}$ alkyl ethoxylates ("AE") including the narrow peaked alkyl ethoxylates and $C_6$-$C_{12}$ alkyl phenol alkoxylates (especially ethoxylates and mixed ethoxy/propoxyates), $C_{12}$-$C_{18}$ betaines and sulfobetaines ("sultaines"), $C_{10}$-$C_{18}$ amine oxides, and the like, can also be included in the surfactant system. The $C_{10}$-$C_{18}$ N-alkyl polyhydroxy fatty acid amides can also be used. See WO 92/06154. Other sugar-derived surfactants include the N-alkoxy polyhydroxy fatty acid amides, such as $C_{10}$-$C_{18}$ N-(3-methoxypropyl)glucamide. The N-propyl through N-hexyl $C_{12}$-$C_{18}$ glucamides can be used for low sudsing. $C_{10}$-$C_{20}$ conventional soaps may also be used. If high sudsing is desired, the branched-chain $C_{10}$-$C_{16}$ soaps may be used. Mixtures of anionic and nonionic surfactants are especially useful. Other conventional useful surfactants are listed in standard texts.

Adjunct Materials

While not essential for the purposes of the present disclosure, the non-limiting list of adjuncts illustrated hereinafter may be suitable for use in the detergent compositions and may be desirably incorporated in certain aspects, for example to assist or enhance performance, for treatment of the substrate to be cleaned, or to modify the aesthetics of the composition as is the case with perfumes, colorants, dyes or the like. The total amount of such adjuncts may range from about 0.1% to about 50%, or from about 1% to about 30%, by weight of the detergent composition.

The precise nature of these additional components and levels of incorporation thereof will depend on the physical form of the composition and the nature of the operation for which it is to be used. Suitable adjunct materials include, but are not limited to, polymers, for example cationic polymers, builders, chelating agents, dye transfer inhibiting agents, dispersants, enzyme stabilizers, catalytic materials, bleach activators, polymeric dispersing agents, clay soil removal/anti-redeposition agents, brighteners, suds suppressors, dyes, additional perfume and perfume delivery systems, structure elasticizing agents, fabric softeners, carriers, hydrotropes, processing aids and/or pigments. In addition to the disclosure below, suitable examples of such other adjuncts and levels of use are found in U.S. Pat. Nos. 5,576,282, 6,306,812 B1 and 6,326,348 B1.

Builders—The compositions of the present invention can comprise one or more detergent builders or builder systems. When present, the compositions will typically comprise at least about 1% builder, or from about 5% or 10% to about 80%, 50%, or 30% by weight, of said builder. Builders include, but are not limited to, the alkali metal, ammonium and alkanolammonium salts of polyphosphates, alkali metal silicates, alkaline earth and alkali metal carbonates, aluminosilicate builders polycarboxylate compounds, ether hydroxypolycarboxylates, copolymers of maleic anhydride with ethylene or vinyl methyl ether, 1,3,5-trihydroxybenzene-2,4,6-trisulphonic acid, and carboxymethyl-oxysuccinic acid, the various alkali metal, ammonium and substituted ammonium salts of polyacetic acids such as ethylenediamine tetraacetic acid and nitrilotriacetic acid, as well as polycarboxylates such as mellitic acid, succinic acid, oxydisuccinic acid, polymaleic acid, benzene 1,3,5-tricarboxylic acid, carboxymethyloxysuccinic acid, and soluble salts thereof.

Bleaching agents and activators—The compositions of the present invention may also include one or more bleaching agents or activators. Bleaching agents and activators are described in U.S. Pat. Nos. 4,412,934 and 4,483,781.

Suds modifiers—The compositions of the present invention may include one or more suds modifiers. Suds modifiers are described in U.S. Pat. Nos. 3,933,672 and 4,136,045.

Dye Transfer Inhibiting Agents—The compositions of the present invention may also include one or more dye transfer inhibiting agents. Suitable polymeric dye transfer inhibiting agents include, but are not limited to, polyvinylpyrrolidone polymers, polyamine N-oxide polymers, copolymers of N-vinylpyrrolidone and N-vinylimidazole, polyvinyloxazolidones and polyvinylimidazoles or mixtures thereof. When present in the compositions herein, the dye transfer inhibiting agents are present at levels from about 0.0001%, from about 0.01%, from about 0.05% by weight of the cleaning compositions to about 10%, about 2%, or about 1% by weight of the cleaning compositions.

Dispersants—The compositions of the present invention can also contain dispersants. Suitable water-soluble organic materials are the homo- or co-polymeric acids or their salts, in which the polycarboxylic acid may comprise at least two carboxyl radicals separated from each other by not more than two carbon atoms.

Hueing Dye—In some aspects, the detergent compositions of the invention comprise a hueing dye. Any suitable hueing dye may be of use. Non-limiting examples of useful hueing dyes include those found in USPN: U.S. Pat. No. 7,205,269; U.S. Pat. No. 7,208,459; and U.S. Pat. No. 7,674,757 B2. For example, hueing dye may be selected from the group of: triarylmethane blue and violet basic dyes, methine blue and violet basic dyes, anthraquinone blue and violet basic dyes, azo dyes basic blue 16, basic blue 65, basic blue 66 basic blue 67, basic blue 71, basic blue 159, basic violet 19, basic violet 35, basic violet 38, basic violet 48, oxazine dyes, basic blue 3, basic blue 75, basic blue 95, basic blue 122, basic blue 124, basic blue 141, Nile blue A and xanthene dye basic violet 10, an alkoxylated triphenylmethane polymeric colorant; an alkoxylated thiopene polymeric colorant; thiazolium dye; and mixtures thereof.

Preferred hueing dyes include the whitening agents found in WO 08/87497 A1. These whitening agents may be characterized by the following structure (I):

(I)

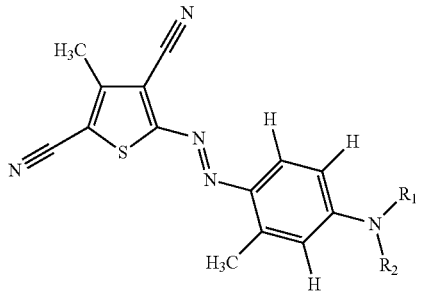

wherein $R_1$ and $R_2$ can independently be selected from:

a) $[(CH_2CR'HO)_x(CH_2CR''HO)_yH]$
   wherein R' is selected from the group consisting of H, $CH_3$, $CH_2O(CH_2CH_2O)_zH$, and mixtures thereof; wherein R" is selected from the group consisting of H, $CH_2O(CH_2CH_2O)_zH$, and mixtures thereof; wherein x+y<5; wherein y≥1; and wherein z=0 to 5;

b) $R_1$=alkyl, aryl or aryl alkyl and $R_2=[(CH_2CR'HO)_x(CH_2CR''HO)_yH]$
   wherein R' is selected from the group consisting of H, $CH_3$, $CH_2O(CH_2CH_2O)_2H$, and mixtures thereof; wherein R" is selected from the group consisting of H, $CH_2O(CH_2CH_2O)_zH$, and mixtures thereof; wherein x+y≤10; wherein y≥1; and wherein z=0 to 5;

c) $R_1=[CH_2CH_2(OR_3)CH_2OR_4]$ and $R_2=[CH_2CH_2(OR_3)CH_2OR_4]$
   wherein $R_3$ is selected from the group consisting of H, $(CH_2CH_2O)_zH$, and mixtures thereof; and wherein z=0 to 10;
   wherein $R_4$ is selected from the group consisting of $(C_1$-$C_{16})$alkyl, aryl groups, and mixtures thereof; and d) wherein R1 and R2 can independently be selected from the amino addition product of styrene oxide, glycidyl methyl ether, isobutyl glycidyl ether, isopropylglycidyl ether, t-butyl glycidyl ether, 2-ethylhexylgycidyl ether, and glycidylhexadecyl ether, followed by the addition of from 1 to 10 alkylene oxide units.

A preferred whitening agent of the present invention may be characterized by the following structure (II):

(II)

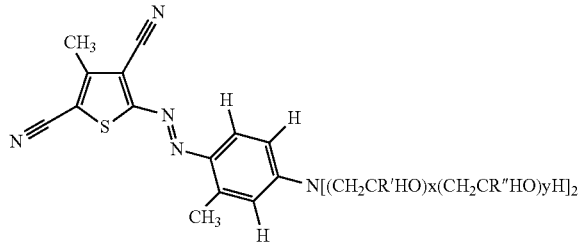

wherein R' is selected from the group consisting of H, $CH_3$, $CH_2O(CH_2CH_2O)_zH$, and mixtures thereof; wherein R" is selected from the group consisting of H, $CH_2O(CH_2CH_2O)_zH$, and mixtures thereof; wherein x+y≤5; wherein y≥1; and wherein z=0 to 5.

Further whitening agents of use include those described in USPN 2008 34511 A1 (Unilever). A preferred agent is "Violet 13" as pictured on p. 4 of this publication.

Structurant—In some aspects of the present invention, the laundry detergent compositions further comprise a structurant. Structurants of use include those disclosed in USPN 2006/0205631A1, 2005/0203213A1, U.S. Pat. Nos. 7,294,611, 6,855,680. U.S. Pat. No. 6,855,680 defines suitable hydroxyfunctional crystalline materials in detail. A suitable structurant is hydrogenated castor oil. Non-limiting examples of useful structurants include those selected from the group of: hydrogenated castor oil; derivatives of hydrogenated castor oil; microfibrillar cellulose; hydroxyfunctional crystalline materials, long-chain fatty alcohols, 12-hydroxystearic acid; clays; and mixtures thereof. In some embodiments, Alternately, low molecular weight organogellants can be used. Such materials are defined in: *Molecular Gels, Materials with Self-Assembled Fibrillar Networks*, Edited by Richard G. Weiss and Pierre Terech.

Pearlescent Agent—In some aspects of the present invention, the laundry detergent compositions further comprise a pearlescent agent. Pearlescent agents of use include those described in USPN 2008/0234165A1. Non-limiting examples of pearlescent agents may be selected from the group of: mica; titanium dioxide coated mica; bismuth oxychloride; fish scales; mono and diesters of alkylene glycol of the formula:

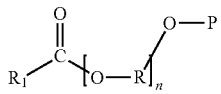

wherein:

a. $R_1$ is linear or branched C12-C22 alkyl group;

b. R is linear or branched C2-C4 alkylene group;

c. P is selected from the group of: H; C1-C4 alkyl; or —$COR_2$; and d. n=1-3.

In some embodiments, R2 is equal to R1, such that the alkylene glycol is ethyleneglycoldistearate (EGDS).

C. Method of Reducing Red Color

The present invention includes methods of reducing the intensity of a red color in a tiron-containing detergent composition. As discussed herein, tiron-containing detergent compositions may exhibit a red or reddish color due to the formation of the red chromophore associated with the metal ligand complex formed between tiron and soluble iron in the detergent composition. According to certain aspects, the method comprises adding a ligand capable of chelating to soluble iron, such as ferric iron, and an iron-displacing species to a detergent composition that comprises tiron and ferric iron.

According to certain aspects, the detergent compositions of the present disclosure may have a reduced red color characteristic of ferric iron/tiron chelate complex formation, for example in liquid detergents such as HDL detergents. The reduction of the red color associated with the detergent composition may be measured by any colorimetric or spectrometric method known in the art. Suitable colorimetric analytical methods include, for example, the Gardner color scale (according to American Society for Testing and Materials ("ASTM") method ASTM D1544, D6166 and/or American Oil Chemists' Society ("AOCS") method AOCS Td-1a-64); the Hunter L.a.b. (CIE) color scale (according to ASTM D5386-93b); the American Public Health Association ("APHA") color scale (according to ASTM D1209 or AOCS Td-1b-64); the Saybolt color scale (according to ASTM D156 or D6045); or the Lovibond (red) scale (according to AOCS Cc-13b-45). It should be noted that the present disclosure is not limited to any specific colorimetric measurement and the reduction of the red color observed in the various aspects of the detergent compositions may be measured by any suitable colorimetric method.

As used herein, with reference to these colorimetric methods and values, the term "low concentrations of ferric iron" includes concentrations of less than 15 ppm, in certain aspects less than 10 ppm and in other aspects less than 5 ppm of ferric iron in the detergent composition.

The formation of red color may be measured, for example, using the spectrophotometric method, e.g., by measuring the absorbance of a specific wavelength of light by the detergent composition/ferric iron mixture. According to this spectrophotometric method, after all components of the detergent composition are combined and the color of the samples equilibrated, the detergent samples are diluted 1:10 by weight with water and analyzed on a Beckman Coulter DU 800 UV/Vis Spectrophotometer in 1 cm disposable cuvettes. The instrument is set to scan from 400-700 nm. Absorbance versus wavelength plots for each measurement are generated. To quantify the amount of color generation, the absorbance at $\lambda$=475 nm, which corresponds to the peak for the $Tiron_3$:$Fe^{3+}$ complex, is measured for all samples. The absorbance for each sample is compared to a positive control, which contains only 5 ppm added $Fe^{3+}$ and 0.35% Tiron. The impact on color reduction of various levels and combinations of ligands and displacing species is then calculated. The background level of absorbance, absent Tiron and $Fe^{3+}$, is also quantified and defined at 0%, such that all of the example formulations have an absorbance between the positive control (100%) and background absorbance (0%). In certain aspects, the color generation is less than 75% of the positive control, in further aspects, it is less than 50% of the positive control, in still further aspects, it is less than 25% of the positive control, in still further aspects it is less than 10% of the positive control, in still further aspects it is less than 5% of the positive control, and in still further aspects it is less than 2% of the positive control.

D. Processes of Making Detergent Compositions

The detergent compositions of the present invention can be formulated into any suitable form and prepared by any process chosen by the formulator, non-limiting examples of which are described in U.S. Pat. Nos. 5,879,584; 5,691,297; 5,574,005; 5,569,645; 5,565,422; 5,516,448; 5,489,392; and 5,486,303.

In one aspect, the detergent compositions disclosed herein may be prepared by combining the components thereof in any convenient order and by mixing, e.g., agitating, the resulting component combination to form a phase stable liquid detergent composition. In one aspect, a liquid matrix is formed containing at least a major proportion, or even substantially all, of the liquid components, e.g., nonionic surfactant, the non-surface active liquid carriers and other optional liquid components, with the liquid components being thoroughly admixed by imparting shear agitation to this liquid combination. For example, rapid stirring with a mechanical stirrer may usefully be employed. While shear agitation is maintained, the tiron and substantially all of any anionic surfactant and the solid ingredients can be added. Agitation of the mixture is continued, and if necessary, can be increased at this point to form a solution or a uniform dispersion of insoluble solid phase particulates within the liquid phase. After some or all of the solid-form materials have been added to this agitated mixture, particles of any enzyme material to be included, e.g., enzyme prills, are incorporated. As a variation of the composition preparation procedure described above, one or more of the solid components may be added to the agitated mixture as a solution or slurry of particles premixed with a minor portion of one or more of the liquid components. After addition of all of the composition components, agitation of the mixture is continued for a period of time sufficient to form compositions having the requisite viscosity and phase stability characteristics. Frequently this will involve agitation for a period of from about 30 to 60 minutes.

E. Methods of Using Detergent Compositions

The detergent compositions of the present disclosure may be used to clean, treat, or pretreat a fabric. Typically at least a portion of the fabric is contacted with the aforementioned detergent compositions, in neat form or diluted in a liquor, e.g., a wash liquor, and then the fabric may be optionally washed and/or rinsed. In one aspect, a fabric is optionally washed and/or rinsed, contacted with the aforementioned detergent compositions and then optionally washed and/or rinsed. For purposes of the present invention, washing includes but is not limited to, scrubbing, and mechanical agitation. Typically after washing and/or rinsing, the fabric is dried. The fabric may comprise most any fabric capable of being laundered or treated.

The detergent compositions of the present disclosure may be used to form aqueous washing solutions for use in the laundering of fabrics. Generally, an effective amount of such compositions is added to water, for example in a conventional fabric laundering automatic washing machine or by a hand washing method, to form such aqueous laundering solutions.

The aqueous washing solution so formed is then contacted, preferably under agitation, with the fabrics to be laundered therewith. An effective amount of the detergent composition, such as the HDL detergent compositions of the present disclosure, may be added to water to form aqueous laundering solutions that may comprise from about 200 to about 15,000 ppm or even from about 300 to about 7,000 pm of detergent composition.

The following representative examples are included for purposes of illustration and not limitation.

EXAMPLES

Liquid detergent compositions may be prepared by mixing together the ingredients listed in the proportions shown:

TABLE 1

| Component | A Wt % | B Wt % | C Wt % | D Wt % | E Wt % |
|---|---|---|---|---|---|
| C12-15 alkyl polyethoxylate (1.8) sulfate | 17.3 | 14.7 | 16.4 | 17.3 | 17.3 |
| C11.8 linear alkylbenzene sulfonic acid | 7.7 | 4.3 | 9.0 | 7.7 | 7.7 |
| C16-17 branched alkyl sulfate | 3.3 | — | 1.8 | 3.3 | 3.3 |
| C24 alkyl 9-ethoxylate | 1.5 | 1.0 | 1.3 | 1.4 | 1.4 |
| C12-14 alkyl dimethyl amine oxide | 1.0 | 0.6 | 1.0 | 0.8 | 0.8 |
| Citric acid | 0.7 | — | 0.7 | 3.5 | 3.5 |
| C12-18 Fatty Acid | 1.5 | 0.9 | 0.9 | 1.5 | 1.5 |
| Tiron | 0.5 | 0.3 | 0.3 | 0.3 | 0.3 |
| DTPA | 0.3 | — | — | — | 0.3 |
| HEDP | — | 0.3 | — | — | — |
| DTPMP | — | — | 0.3 | 0.3 | — |
| Phenylboronic Acid | 1.0 | 0.2 | 0.1 | — | — |
| $Al^{3+}$ (From Aluminum Citrate) | — | — | — | 0.03 | 0.03 |
| Soil Suspending Alkoxylated Polyalkylenimine Polymer[1] | 1.4 | 1.4 | 1.5 | 1.4 | 1.4 |
| Grease Cleaning Alkoxylated Polyalkylenimine Polymer[2] | 1.9 | 1.9 | 1.9 | 1.3 | 1.3 |
| Fluorescent whitening agent | 0.3 | 0.3 | 0.2 | 0.2 | 0.2 |
| Calcium Formate | 0.10 | 0.05 | 0.09 | 0.09 | — |
| Protease (40.6 mg/g)[3] | 1.5 | 1.7 | 1.7 | 1.5 | — |
| Natalase 200 L (29.26 mg/g)[4] | 0.34 | 0.34 | 0.34 | 0.34 | — |
| Mannaway 25 L (25 mg/g)[4] | — | — | — | 0.32 | — |
| Whitezyme (20 mg/g)[4] | — | 0.065 | 0.06 | 0.06 | — |
| Pectate lyase active enzyme protein (Pectawash) | — | — | — | 0.01 | — |
| Lipase active enzyme protein (Lipolex) | — | — | — | 0.03 | — |
| Hydrogenated castor oil[5] | 0.12 | 0.10 | 0.12 | — | — |
| Silicone | — | 0.10 | 0.10 | — | — |
| Hueing Dye | 0.05 | 0.02 | 0.02 | — | 0.02 |
| Water, perfumes, dyes, buffers, neutralizers, stabilizers, suds suppressors, solvents, and other optional components | to 100% pH 8.1-8.5 | to 100% pH 8.1-8.5 | to 100% pH 8.1-8.5 | to 100% pH 8.1-8.5 | to 100% pH 8.1-8.5 |

[1]600 g/mol molecular weight polyethylenimine core with 20 ethoxylate groups per —NH. Available from BASF (Ludwigshafen, Germany).
[2]600 g/mol molecular weight polyethylenimine core with 24 ethoxylate groups per —NH and 16 propoxylate groups per —NH. Available from BASF (Ludwigshafen, Germany).
[3]Available from Genencor International, South San Francisco, CA.
[4]Available from Novozymes, Bagsvaerd, Denmark.
[5]Available under the tradename Thixcin ® R from Elementis Specialties, Highstown, NJ.

TABLE 2

| Ingredient | F Wt % | G Wt % | H Wt % | I Wt % |
|---|---|---|---|---|
| C12-15 alkyl polyethoxylate (3.0) sulfate | 8.5 | — | 4 | 2.9 |
| C11.8 linear alkylbenzene sulfonc acid | 11.4 | 11 | 12 | 8.2 |
| C14-15 alkyl 7-ethoxylate | — | 7 | 2 | 4.9 |
| C12-14 alkyl 7-ethoxylate | 7.6 | 1 | 0.5 | 0.4 |
| C12-14 alkyl dimethyl amine oxide | — | 0.4 | — | — |
| C12-18 Fatty Acid | 9.5 | 2.7 | 0.8 | 3.4 |
| Citric acid | 2.8 | 3.3 | 2.3 | 3.5 |
| Protease (40.6 mg/g)[1] | 1.0 | 0.5 | 0.5 | — |
| Natalase 200 L (29.26 mg/g)[2] | — | 0.1 | 0.1 | — |
| Termamyl Ultra (25.1 mg/g)[2] | 0.7 | 0.05 | 0.05 | — |
| Mannaway 25 L (25 mg/g)[2] | 0.1 | 0.05 | 0.05 | — |
| Whitezyme (20 mg/g)[2] | 0.2 | 0.05 | 0.05 | — |
| Fluorescent Whitening Agent | 0.2 | 0.1 | 0.05 | 0.1 |
| Tiron | 0.5 | 0.3 | 0.15 | 0.15 |
| DTPMP | 0.5 | 0.3 | — | — |
| HEDP | — | — | 0.30 | 0.30 |
| Phenylboronic Acid | 1.0 | — | 0.2 | — |

TABLE 2-continued

| Ingredient | F Wt % | G Wt % | H Wt % | I Wt % |
|---|---|---|---|---|
| $Al^{3+}$ (From Aluminum Citrate) | — | 0.03 | — | 0.03 |
| Soil Suspending Alkoxylated Polyalkylenimine[3] | — | — | 0.1 | — |
| Zwitterionic ethoxylated quaternized sulfated hexamethylene diamine[4] | 2.1 | 0.7 | 0.7 | 1.6 |
| Grease Cleaning Alkoxylated Polyalkylenimine[5] | — | — | 0.1 | 0.1 |
| PEG-PVAc Polymer[6] | 0.9 | 0.8 | 0.8 | 0.5 |
| Hydrogenated castor oil[7] | 0.8 | 0.4 | 0.4 | 0.4 |
| CaCl2 | — | 0.05 | 0.05 | — |
| Sodium Formate | — | 0.2 | 0.2 | — |
| Na Cumene Sulfonate | — | 1 | 1 | 1 |
| Hueing Dye | — | 0.03 | 0.03 | 0.03 |
| Water, perfumes, dyes, buffers, neutralizers, stabilizers, suds suppressors and other optional components | to 100% pH 8.0-8.2 | to 100% pH 8.0-8.2 | to 100% pH 8.0-8.2 | to 100% pH 8.0-8.2 |

[1]Available from Genencor International, South San Francisco, CA.
[2]Available from Novozymes, Bagsvaerd, Denmark.
[3]600 g/mol molecular weight polyethylenimine core with 20 ethoxylate groups per —NH. Available from BASF (Ludwigshafen, Germany).
[4]Described in WO 01/05874 and available from BASF (Ludwigshafen, Germany).
[5]600 g/mol molecular weight polyethylenimine core with 24 ethoxylate groups per —NH and 16 propoxylate groups per —NH. Available from BASF (Ludwigshafen, Germany).
[6]PEG-PVA graft copolymer is a polyvinyl acetate grafted polyethylene oxide copolymer having a polyethylene oxide backbone and multiple polyvinyl acetate side chains. The molecular weight of the polyethylene oxide backbone is about 6000 and the weight ratio of the polyethylene oxide to polyvinyl acetate is about 40 to 60 and no more than 1 grafting point per 50 ethylene oxide units. Available from BASF (Ludwigshafen, Germany).
[7]Available under the tradename Thixcin ® R from Elementis Specialties, Highstown, NJ.

Test Data

The detergent formula in Table 3 below was created for testing.

TABLE 3

| Component | Percentage |
|---|---|
| C12-15 alkyl polyethoxylate (1.8) sulfate | 14.6 |
| C11.8 linear alkylbenzene sulfonic acid | 6.9 |
| C16-17 branched alkyl sulfate | 2.8 |
| C24 alkyl 9-ethoxylate | 1.2 |
| C12-14 alkyl dimethyl amine oxide | 0.9 |
| Citric acid | 0.6 |
| C12-18 Fatty Acid | 1.4 |
| Soil Suspending Alkoxylated Polyalkylenimine Polymer[1] | 1.3 |
| Grease Cleaning Alkoxylated Polyalkylenimine Polymer[2] | 1.7 |
| Fluorescent whitening agent | 0.3 |
| 1,2-Propanediol | 3.9 |
| Diethylene Glycol (DEG) | 1.0 |
| Polyethylene Glycol 4000 Da | 0.1 |
| Monoethanolamine (MEA) | 1.0 |
| Sodium Hydroxide (NaOH) | 2.6 |
| Calcium Formate | 0.1 |
| Ethanol | 2.0 |
| Tiron, DTPA, HEDP, DTPMP, Phenylboronic Acid, Aluminum Citrate, and $FeCl_3$ | As Noted Below |
| Water | Balance |

[1]600 g/mol molecular weight polyethylenimine core with 20 ethoxylate groups per —NH. Available from BASF (Ludwigshafen, Germany).
[2]600 g/mol molecular weight polyethylenimine core with 24 ethoxylate groups per —NH and 16 propoxylate groups per —NH. Available from BASF (Ludwigshafen, Germany).

The concentrations of Tiron, HEDP, DTPA, DTPMP, Phenylboronic Acid (PBA), $Al^{3+}$ and $Fe^{3+}$ are shown in Tables 4, 5, and 6 below. $Fe^{3+}$ is added as $FeCl_3$, and $Al^{3+}$ is added as aluminum citrate. After all the components in each sample are combined, the sample is capped and shaken on a vortex mixer @ 3000 rpm for 20 seconds to homogenize. The pH of each sample is then adjusted to between 8 and 8.5 using 1.0 N HCl and NaOH.

After the color of the samples has equilibrated, the detergent samples are diluted 1:10 by weight with water and then analyzed on a Beckman Coulter DU 800 UV/Vis Spectrophotometer in 1 cm disposable cuvettes. The instrument is set to scan from 400-700 nm. Absorbance versus wavelength plots for each measurement are generated. To quantify the amount of color generation, the absorbance at $\lambda$=475 nm, which corresponds to the peak for the $Tiron_3$:$Fe^{3+}$ complex, is measured for all samples and compared to a sample containing 5 ppm added $Fe^{3+}$ and 0.35% Tiron. This sample is denoted as the positive control (sample #2) in Tables 4, 5, and 6 below, where the impact on color reduction of various levels and combinations of ligands capable of chelating to $Fe^{3+}$ and iron-displacing species is shown. The background level of absorbance, absent Tiron and $Fe^{3+}$, is also quantified and defined at 0%, such that all of the example formulations have absorbances between the positive control (100%) and background absorbance (0%).

TABLE 4

| Sample # | Added $Fe^{3+}$ Conc. (ppm) | Tiron Conc. (wt. %) | Ligand capable of chelating to $Fe^{3+}$ | Ligand capable of chelating to $Fe^{3+}$ conc. (wt. %) | Iron-displacing species | Iron-displacing species conc. (wt. %) | Absorbance at 475 nm as compared to positive control (%) |
|---|---|---|---|---|---|---|---|
| 0 | 0 | 0.00% | None | 0.0% | None | 0.0% | 0% |
| 1 | 0 | 0.35% | None | 0.0% | None | 0.0% | 14% |
| 2 (positive control) | 5 | 0.35% | None | 0.0% | None | 0.0% | 100% |
| 4 | 5 | 0.35% | HEDP | 0.35% | None | 0.0% | 79% |
| 8 | 5 | 0.35% | HEDP | 0.35% | PBA | 1.6% | 10% |

TABLE 4-continued

| Sample # | Added $Fe^{3+}$ Conc. (ppm) | Tiron Conc. (wt. %) | Ligand capable of chelating to $Fe^{3+}$ | Ligand capable of chelating to $Fe^{3+}$ conc. (wt. %) | Iron-displacing species | Iron-displacing species conc. (wt. %) | Absorbance at 475 nm as compared to positive control (%) |
|---|---|---|---|---|---|---|---|
| 10 | 5 | 0.35% | HEDP | 0.35% | $Al^{3+}$ | 0.03% | 31% |
| 20 | 5 | 0.35% | HEDP | 0.35% | PBA | 0.2% | 56% |
| 22 | 5 | 0.35% | HEDP | 0.35% | PBA | 0.5% | 23% |
| 24 | 5 | 0.35% | HEDP | 0.35% | PBA | 1.0% | 19% |

The data with regard to sample 4 in Table 4 shows that a formulation containing HEDP, absent any displacing species, only reduces the color of the sample to 79% of the positive control—sample 2, which has an identical composition but absent HEDP. The data with regard to samples 8 and 10 show that the addition of a displacing species, such as PBA or $Al^{3+}$, reduces the color to 10% or 31% of the positive control. Reduced amounts of PBA, even as low at 0.2%, reduce the color.

TABLE 5

| Sample # | Added $Fe^{3+}$ Conc. (ppm) | Tiron Conc. (wt. %) | Ligand capable of chelating to $Fe^{3+}$ | Ligand capable of chelating to $Fe^{3+}$ conc. (wt. %) | Iron-displacing species | Iron-displacing species conc. (wt. %) | Absorbance at 475 nm as compared to positive control (%) |
|---|---|---|---|---|---|---|---|
| 0 | 0 | 0.00% | None | 0.0% | None | 0.0% | 0% |
| 1 | 0 | 0.35% | None | 0.0% | None | 0.0% | 14% |
| 2 (positive control) | 5 | 0.35% | None | 0.0% | None | 0.0% | 100% |
| 3 | 5 | 0.35% | DTPA | 0.35% | None | 0.0% | 101% |
| 7 | 5 | 0.35% | DTPA | 0.35% | PBA | 1.6% | 7% |
| 9 | 5 | 0.35% | DTPA | 0.35% | $Al^{3+}$ | 0.03% | 2% |
| 19 | 5 | 0.35% | DTPA | 0.35% | PBA | 0.2% | 83% |
| 21 | 5 | 0.35% | DTPA | 0.35% | PBA | 0.5% | 19% |
| 23 | 5 | 0.35% | DTPA | 0.35% | PBA | 1.0% | 7% |

The data with regard to sample 3 in Table 5 shows that a formulation containing DTPA, absent any displacing species, provides no reduction in color versus the positive control (sample 2). The data with regard to samples 7 and 9 show that the addition of a displacing species, such as PBA or $Al^{3+}$, reduces the color to 7% or 2% of the positive control—sample 2. Reduced amounts of PBA, even as low at 0.2%, reduce the color.

TABLE 6

| Sample # | Added $Fe^{3+}$ Conc. (ppm) | Tiron Conc. (wt. %) | Ligand capable of chelating to $Fe^{3+}$ | Ligand capable of chelating to $Fe^{3+}$ conc. (wt. %) | Iron-displacing species | Iron-displacing species conc. (wt. %) | Absorbance at 475 nm as compared to positive control (%) |
|---|---|---|---|---|---|---|---|
| 0 | 0 | 0.00% | None | 0.0% | None | 0.0% | 0% |
| 1 | 0 | 0.35% | None | 0.0% | None | 0.0% | 14% |
| 2 (positive control) | 5 | 0.35% | None | 0.0% | None | 0.0% | 100% |
| 25 | 0 | 0.3% | DTPMP | 0.3% | None | 0.0% | 16% |
| 26 | 5 | 0.3% | DTPMP | 0.3% | None | 0.0% | 93% |
| 27 | 5 | 0.3% | DTPMP | 0.3% | $Al^{3+}$ | 0.03% | 4% |

The data with regard to sample 26 in Table 6 shows that a formulation containing DTPMP, absent any displacing species, only reduces the color to 93% of the positive control—sample 2. The addition of a displacing species, such as $Al^{3+}$, reduces the color to 4% of the positive control.

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm".

All documents cited in the Detailed Description of the Invention are, in relevant part, incorporated herein by reference; the citation of any document is not to be construed as an admission that it is prior art with respect to the present invention. To the extent that any meaning or definition of a term in this document conflicts with any meaning or definition of the same term in a document incorporated by reference, the meaning or definition assigned to that term in this document shall govern.

While particular aspects of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A detergent composition comprising:

a) from about 0.015% by weight to about 10% by weight of the composition of tiron (1,2-dihydroxybenzene-3,5-disulfonic acid, or mono- or di-sulfonate salts of the acid), b) from about 0.015% by weight to about 10% by weight of the composition of a ligand capable of chelating to $Fe^{3+}$, wherein the ligand has a binding constant for $Fe^{3+}$ that is greater than $10^{18}$ $M^{-1}$, and wherein the ligand is selected from the group consisting of aminocarboxylates containing at least two N atoms, aminophosphonates containing at least two N atoms, and geminal bisphosphonates, c) an iron-displacing species selected from the group consisting of i) phenyl boronic acid, ii) $A1^{3+}$, and iii) mixtures thereof; and d) at least about 0.2 ppm $Fe^{3+}$.

2. The detergent composition of claim 1, wherein said composition comprises from about 0.05% by weight to about 2% by weight of said phenyl boronic acid.

3. The detergent composition of claim 1, wherein the iron-displacing species comprises $Al^{3+}$, and wherein the molar ratio of tiron to $Al^{3+}$ is from about 3:1 to about 1:20.

4. The detergent composition of claim 1, wherein the mole percentage of tiron that is bound to $Fe^{3+}$ is less than about 50%.

5. The detergent composition of claim 1, wherein said ligand capable of chelating to $Fe^{3+}$ is selected from the group consisting of diethylenetriaminepentaacetic acid (DTPA), ethylenediaminetetraacetic acid (EDTA), propylene diamine tetraacetic acid (PDTA), hydroxyl-ethane diphosphonic acid (HEDP), N-(hydroxyethyl)-ethylenediaminetriacetic acid (HEDTA), ethylenediamine-N,N'-disuccinic acid (EDDS), diethylene triamine penta methylene phosphonic acid (DTPMP), sodium salt of carboxymethylated polyethyleneimine, and combinations thereof.

6. The detergent composition of claim 1, wherein the molar ratio of tiron to the ligand capable of chelating $Fe^{+3}$ to $Fe^{+3}$ is from about 1:0.1(b/x):0.008 to about 1:5(b/x):0.35, wherein x is the molecular weight of the ligand and wherein b is 278 for aminocarboxylates containing at least two nitrogen atoms, wherein b is 573 for aminophosphonates containing at least two nitrogen atoms, and wherein b is 206 for geminal bisphosphonates.

7. The detergent composition of claim 1, further comprising an enzyme and at least one calcium salt.

8. The detergent composition of claim 7, wherein the concentration of ligand capable of chelating $Fe^{+3}$ is from about 0.015% by weight to about 0.35% by weight and the molar ratio of ligand to $Ca^{2+}$ from the calcium salt ranges from about (b/x):0.4 to about (b/x):10, wherein x is the molecular weight of the ligand and wherein b is 278 for aminocarboxylates containing at least two nitrogen atoms, wherein b is 573 for aminophosphonates containing at least two nitrogen atoms, and wherein b is 206 for geminal bisphosphonates.

9. The detergent composition of claim 8, wherein the calcium salt is selected from the group consisting of calcium formate and calcium chloride.

10. A detergent composition comprising:

a) from about 0.015% by weight to about 10% by weight of the composition of tiron (1,2-dihydroxybenzene-3,5-disulfonic acid, or mono- or di-sulfonate salts of the acid), b) from about 0.015% by weight to about 10% by weight of the composition of a ligand capable of chelating to $Fe^{3+}$, wherein the ligand has a binding constant for $Fe^{3+}$ that is greater than $10^{18}$ $M^{-1}$, and wherein the ligand is selected from the group consisting of aminocarboxylates containing at least two N atoms, aminophosphonates containing at least two N atoms, and geminal bisphosphonates, c) a boron-containing compound selected from the group consisting of i) a compound of formula I:

(I)

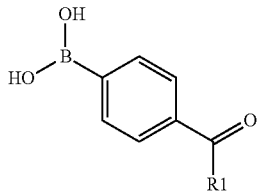

wherein $R^1$ is selected from the group consisting of hydrogen, hydroxy, C1-C6 alkyl, substituted C1-C6 alkyl, C2-C6 alkenyl and substituted C2-C6 alkenyl;

ii) a compound selected from the group consisting of: thiophene-2 boronic acid, thiophene-3 boronic acid, acetamidophenyl boronic acid, benzofuran-2 boronic acid, naphthalene-1 boronic acid, naphthalene-2 boronic acid, 2-formylphenylboronic acid, 3-formylphenylboronic acid, 1-thianthrene boronic acid, 4-dibenzofuran boronic acid, 5-methylthiophene-2 boronic acid, thionaphthene boronic acid, furan-2 boronic acid, furan-3 boronic acid, 4,4 biphenyl-diboronic acid, 6-hydroxy-2-naphtalene, 4-(methylthio)phenyl boronic acid, 4-(trimethyl-silyl)phenyl boronic acid, 3-bromothiophene boronic acid, 4-methylthiophene boronic acid, 2-naphthyl boronic acid, 5-bromothiophene boronic acid, 5-chlorothiophene boronic acid, dimethylthiophene boronic acid, 2-bromophenyl boronic acid, 3-chlorophenyl boronic acid, 3-methoxy-2-thiophene, p-methyl-phenylethyl boronic acid, 2-thianthrene boronic acid, dibenzothiophene boronic acid, 9-anthryl boronic acid, 3,5 dichlorophenyl boronic, acid, diphenyl boronic acid anhydride, o-chlorophenyl boronic acid, p-chlorophenyl boronic acid,m-bromophenyl boronic acid, p-bromophenyl boronic acid, p-fluorophenyl boronic acid, p-tolyl boronic acid, o-tolyl boronic acid, octyl boronic acid, 1,3,5 trimethylphenyl boronic acid, 3-chloro-4-fluorophenyl boronic acid, 3-aminophenyl boronic acid, 3,5-bis-(trifluoromethyl)phenyl boronic acid, 2,4 dichlorophenyl boronic acid, 4-methoxyphenyl boronic acid, and combinations thereof; and iii) mixtures thereof; and d) at least about 0.2 ppm $Fe^{3+}$.

11. The detergent composition of claim 10, wherein the boron-containing compound is the compound of formula I, wherein $R^1$ of formula I is a C1-C6 alkyl or is hydrogen.

* * * * *